United States Patent [19]

Lahr et al.

[11] 3,930,755

[45] Jan. 6, 1976

[54] AIR-PRESSURE ACTUATED SLURRY PUMP

[76] Inventors: Lawrence N. Lahr, Rte. 3, Box 373; Donald J. Lahr, Rte. 3, Box 374, both of Sauk Center, Minn. 56378

[22] Filed: Aug. 9, 1974

[21] Appl. No.: 496,304

[52] U.S. Cl. ..... 417/120; 417/129; 417/130; 417/138; 417/143; 417/318

[51] Int. Cl.[2] ..... F04F 1/06; F04F 3/00

[58] Field of Search ..... 417/120, 129, 130, 138, 417/142, 143, 900, 118, 144, 137, 318

[56] References Cited

UNITED STATES PATENTS

| | | | |
|---|---|---|---|
| 350,761 | 10/1886 | Neff | 417/118 |
| 1,492,171 | 8/1924 | Jannings | 417/120 |
| 1,830,424 | 11/1931 | Codne | 417/120 X |
| 2,270,434 | 1/1942 | Gould | 417/129 |
| 2,315,824 | 4/1943 | Sweeny | 417/129 X |
| 3,173,379 | 3/1965 | Jolly | 417/123 |
| 3,422,768 | 1/1969 | Repp | 417/138 |
| 3,662,715 | 5/1972 | Schapler | 119/28 |
| 3,667,869 | 6/1972 | Schlecht | 417/900 X |

FOREIGN PATENTS OR APPLICATIONS

| | | | |
|---|---|---|---|
| 486,454 | 11/1953 | Italy | 417/129 |

*Primary Examiner*—William L. Freeh
*Assistant Examiner*—Richard E. Gluck
*Attorney, Agent, or Firm*—James R. Haller; H. Dale Palmatier

[57] ABSTRACT

A slurry pump including a pressure tank with an inlet and a lower outlet and having a pneumatically operated, inwardly opening closure at the inlet and a hinged, outwardly opening door at the outlet swingable between opened and closed positions. An external source of air under pressure hydraulically shuts the closure and pressurizes the tank, forcing a semi-liquid slurry such as liquid manure contained within the tank through the outlet and into a duct leading to a lagoon or the like. A slurry level sensor shuts off the supply of air to the tank when the slurry reaches a given level in the tank.

10 Claims, 5 Drawing Figures

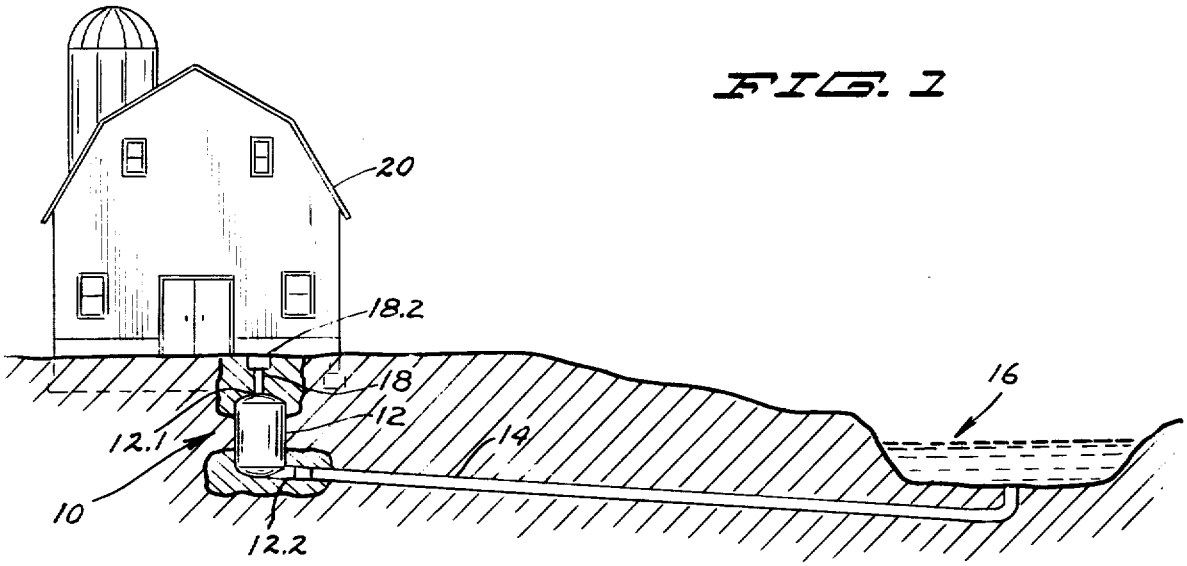
FIG. 1
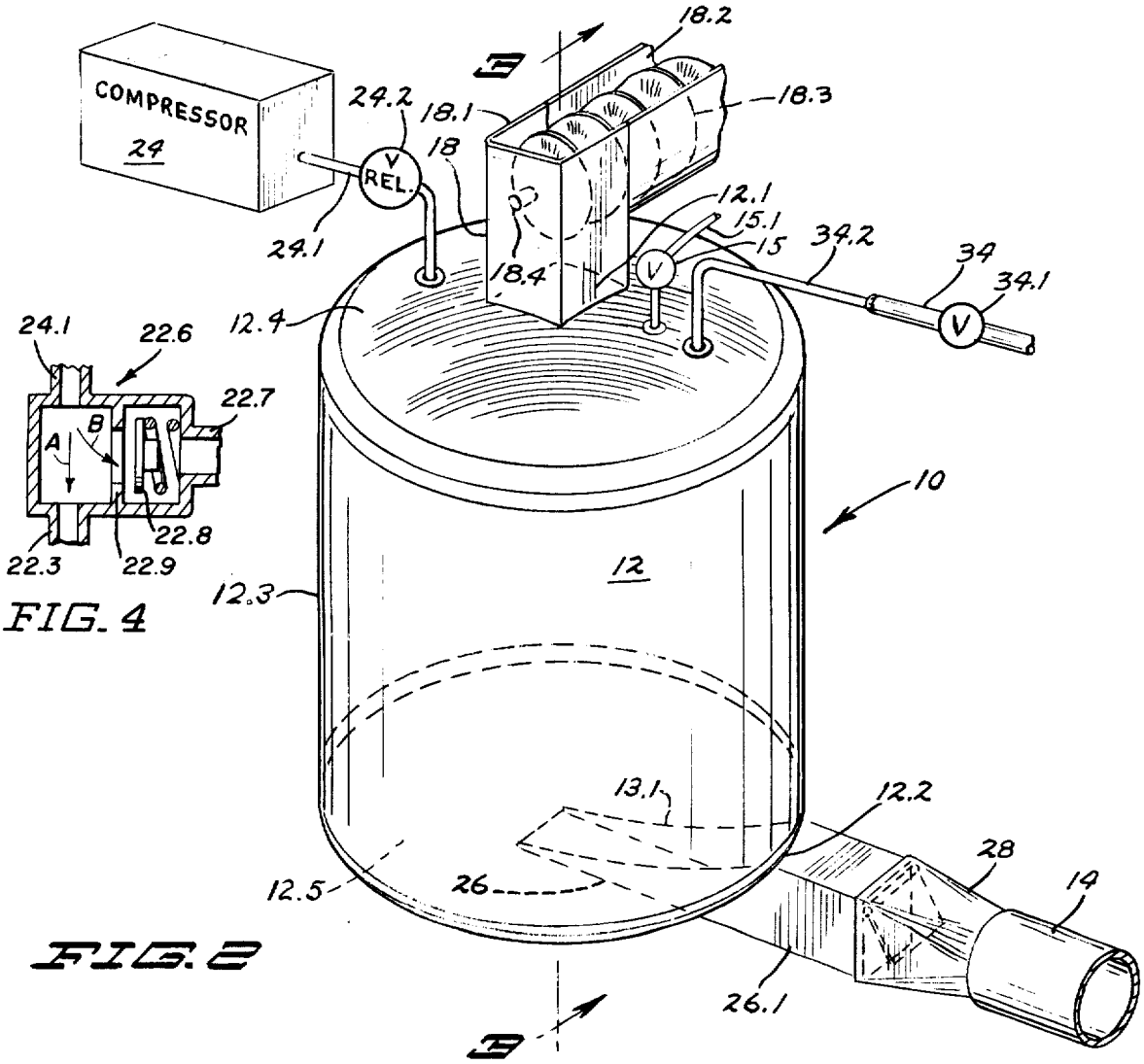
FIG. 4
FIG. 2

CONTROL BOX
30.1
COMPRESSOR
-24-
24.3
24.1
24.4
24.2
V
REL.
18.1
18.4
18.3
18.2
18
12.6
12.1
12.9
22.6
22.3
22.1
22.7
22
22.4
22.5
22.2
12.8
12.7
12.6a
32.2
34.2
34.1
34
$H_2O$
15
15.1
13
12.4
32.1
34.3
12
10
12.8
32
12.3
30
31
26.4
26.2
26.3
12.5
26
12.2
26.1
28
28.1
14

30.5
30
30.4
30.3
30.2

AIR-PRESSURE ACTUATED SLURRY PUMP

BACKGROUND OF THE INVENTION

The disposal or use of farm animal waste has become increasingly important due not only to the pollution such wastes can cause, but also to the value of such wastes as fertilizers. In barns or other feeding areas for cattle, the cattle feces and urine are ordinarily scraped into cement troughs, and the resultant semi-liquid manure is collected for eventual use as fertilizer. Such manure may be placed in compost heaps, or may be conveyed to a lagoon for storage. Lagoon storage is often desirable because the manure is often stored in a location removed several hundred yards from the barn, and because the surface of the waste material in the lagoon solidifies, rendering the lagoon substantially odorless. The semi-liquid manure slurry (hereinafter referred to as "liquid manure") eventually is pumped from the lagoon and is spread upon the ground in the usual manner.

Automatic barn cleaning devices which carry animal wastes from the barn to storage areas have been used for many years. In one device, the liquid manure is conveyed to a collection point and is then pumped, using a large, reciprocating pump, through a line leading to a storage lagoon. Manure pumps of this type often clog up because of encounters with substantially solid chunks of hay or straw or other material which becomes entrained in the liquid manure. When this happens, the pump assembly can be cleared of the obstruction only with some difficulty and waste of time. Such manure pumps, moreover, have many moving parts, and the pumping action depends upon reasonably close tolerances being maintained between the pump piston and cylinder. Because the cylinder interior is ordinarily exposed to receive liquid manure for pumping, such pumps also provide a safety hazard to one working in the immediate vicinity, and ordinarily are carefully monitored during operation.

A simple, comparatively inexpensive pump for liquid manure or other slurrys which would avoid the safety hazards and substantially constant monitoring associated with piston pumps of the type described would greatly benefit the farming industry, and is much to be desired.

BRIEF DESCRIPTION OF THE INVENTION

The invention relates to a slurry pump, particularly useful for pumping liquid manure from a barn to a storage lagoon. The pump includes a pressure tank with upper and lower walls provided with an inlet and an outlet, respectively. The inlet has an inwardly and downwardly opening closure hinged thereto with a pneumatic cylinder mounted within the tank and connected to the closure to close the latter with an air-tight seal. The outlet is connectable exteriorly with a discharge duct for carrying liquid manure or other slurry to a storage area such as a lagoon. The outlet is provided with an outwardly opening door swingable between opened and closed positions in response to outward and inward flow of slurry, respectively, through the outlet; the door prevents backflow of slurry through the outlet port. An external source of air under pressure communicates with the pneumatic cylinder to sealingly close the closure, and communicates with the tank interior to pressurize the latter, whereby a slurry within the tank is forced downwardly and outwardly through the outlet and discharge duct. A slurry level sensor means provided within the tank senses the level of slurry in the tank, and a control responds thereto to shut off the supply of air to the tank when the slurry in the tank has decreased to a given level.

DESCRIPTION OF THE DRAWING

FIG. 1 is a schematic, elevational view showing the location of a slurry pump of the invention with respect to a barn and storage lagoon;

FIG. 2 is a perspective, partially schematic view of a slurry pump of the invention;

FIG. 3 is a cross-sectional view, taken generally along line 3—3 of FIG. 2; and FIGS. 4 and 5 are respective schematic representations of a pressure-actuated directional valve and a float employable in the present invention.

DETAILED DESCRIPTION OF THE PREFERRED EMBODIMENT

Figures 3, 5:
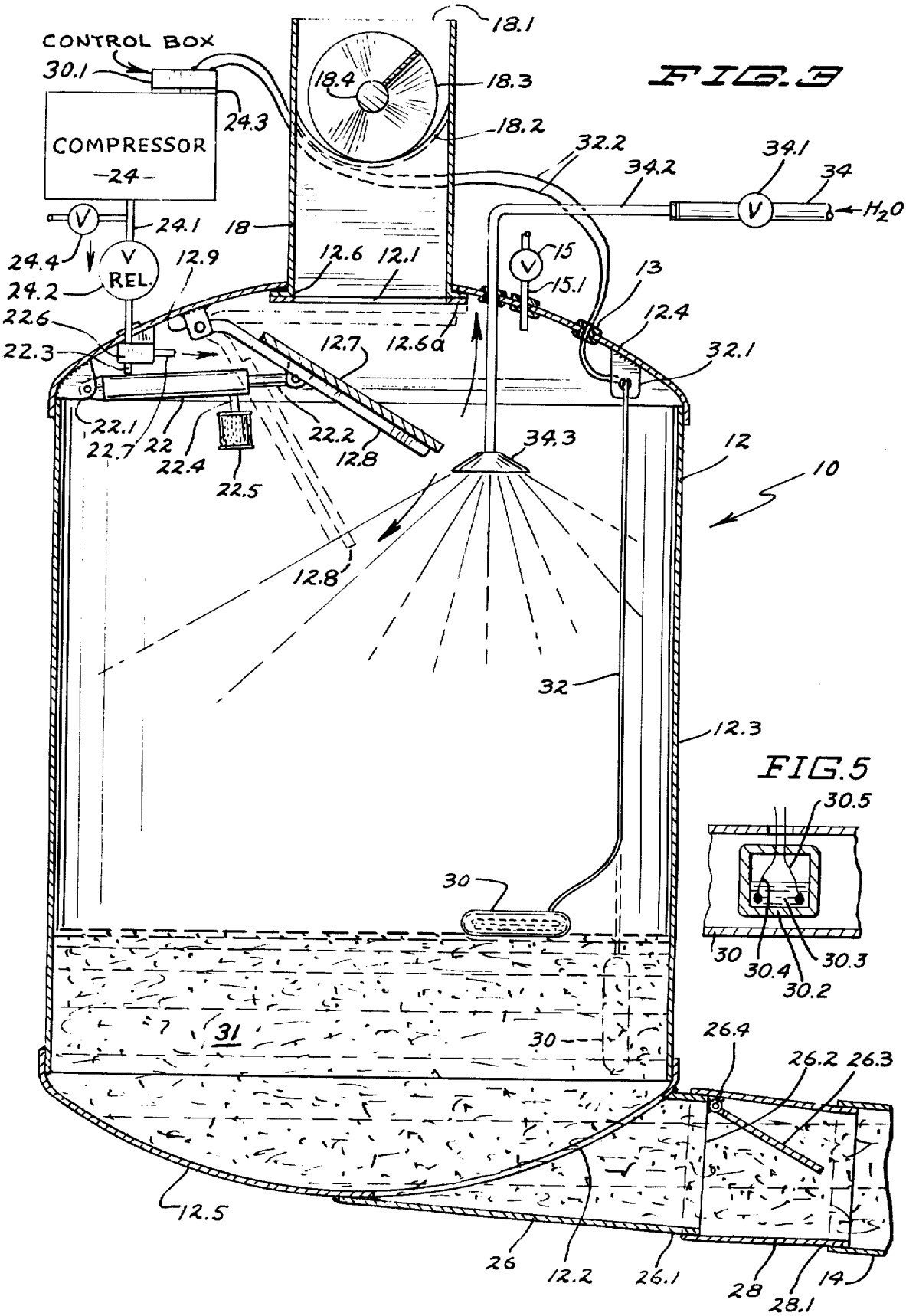

Referring first to FIGS. 1 and 2, the slurry pump of the invention is designated generally as 10 and includes a pressure tank 12 having an inlet 12.1 and an outlet 12.2, the latter being connectable to a slurry duct 14. The tank preferably is buried underground with its lower end and a portion of the slurry duct encased in concrete, as shown in FIG. 1, the slurry duct 14 leading from the lower end of the tank to a lagoon depicted generally as 16. At its upper end, the tank is provided with an upward chute 18, the open top 18.1 of which receives liquid manure from a trench or trough 18.2 within a barn 20 or other cattle feeding area. Briefly, liquid manure enters the tank through its inlet 12.1 and thereafter is forced by air pressure through the outlet 12.2 and through the duct 14 into the lagoon 16.

Referring now in detail to FIGS. 2 and 3, the tank 12 is provided with cylindrical side walls 12.3 and domed top and bottom walls 12.4, 12.5 respectively. The tank is of sturdy construction, and is adapted to withstand internal pressures of, for example, 67 p.s.i.g. The domed top and bottom walls overlie and are welded to the cylindrical side wall, as shown best in FIG. 3.

A substantially square inlet 12.1 is provided centrally in the top wall 12.4 of the tank, and the inner surface of the top wall adjacent the edges of the inlet are provided with a steel flange 12.6 to thus provide a lower inlet periphery which lies in a horizontal plane. Cemented to the steel flange 12.6 is a resilient gasket **12.6*a*** of foam rubber or other manure-resistant material.

To the periphery of the opening 12.1 in the domed upper wall 12.4 is welded an upright chute 18. A transverse trough 18.2, which may be a manure-receiving trough in a barn 20, is attached into a recessed side wall of the chute 18, and a manure-conveying device such as an auger 18.3 is caused to rotate about its central supporting shaft 18.4, the end of which is journaled into the opposed side wall of the chute.

A closure, such as a steel plate 12.7, is carried within the tank 12 and has a generally planar upper surface of appropriate size to contact the gasket **12.6*a* and thus seal shut the inlet 12.1 of the tank. A pair of elongated brackets 12.8 are connected to the underside of the plate 12.7, and have outwardly extending ends which are hinged to a pair of lugs 12.9 extending inwardly from the adjacent interior surface of the top wall 12.4. It will thus be understood that the plate 12.7 must move upwardly in order to come into sealing contact with inlet gasket 12.6*a***, and is thus continuously urged open by the force of gravity.

An air-operated pneumatic cylinder 22 is carried within the tank and is swingably mounted at one end to a supporting brace 22.1 projecting inwardly from an edge of the top wall 12.4. At its other end, the piston 22.2 of the pneumatic cylinder is pivotally connected to the underside of the cover 12.7, such tath when the piston extends, the cover is caused to move between the open, lower dotted line position shown in FIG. 3 upwardly to its closed position sealed tightly against the gasket 12.6*a* in the upper wall of the tank. The pneumatic cylinder 22 is provided with a pair of ports 22.3, 22.4 on opposite sides of the piston. The port 22.4 nearest the cover 12.7 is provided with a filter cannister 22.5 through which air from within the tank may enter the cylinder as the piston is retracted during opening of the cover 12.7. The other port 22.3 of the cylinder includes a flexible air line communicating with an interior pressure-actuated directional valve 22.6 such as a pressure relief valve within the tank, and the latter in turn communicates with a source of air under pressure, as will now be described.

A source of air under superatmospheric pressure, such as an electrically driven air compressor 24, may be suitably positioned within the barn adjacent the chute 18. The compressor desirably is capable of providing air at a pressure of 30 p.s.i.g. or above. Pressurized air from the compressor passes through an air line 24.1 and through an exterior safety valve 24.2, the air line passing then through an air-tight port in the top wall 12.4 of the tank and communicating with the interior pressure relief valve 22.6 adjacent the pneumatic cylinder 22. The latter valve includes an air escape port 22.7 within the tank, and is pre-set to open at a pressure lower than that at which the safety valve 24.2 opens. The small port through which the air line 24.1 passes preferably is lined with a resilient gasket of rubber or other material which provides an air-tight seal between the top wall 12.4 and the air line. As shown in FIG. 4, the valve 22.6 may be a common pressure relief valve having a plug 22.8 spring-pressed against a valve seat 22.9. When the plug is seated, air flows in the direction shown by arrow A. When pressure within the plug increases to a predetermined value, the plug is unseated and air follows the path shown generally by arrow B. A bleeder valve 24.4 in the air line 24.1 may be opened to bleed air from the cylinder.

The domed, bottom wall 12.5 of the tank is provided with a wide slot 13.1 (shown best in FIG. 2) extending approximately from the center of the lower wall to the edge thereof. To the edges of the slot are welded arcuately cut walls of a channel 26, the channel itself being generally U-shaped in cross section and having an outwardly extending, generally rectangular lip 26.1 forming a rectangular passage or duct leading from the tank and terminating abruptly a short distance outwardly from the cylindrical tank walls 12.3, as best shown in FIG. 3. Welded to the lip 26.1 is a tubular connector 28 which varies from a rectangular cross section at its attachment to the lip 26.1 to a circular cross section at its outer end 28.1. Attached to the circular outer end 28.1 is a relatively long length of large diameter, rigid, polyvinylchloride tubing 14, the latter being tightly attached to the connector 28 by means of an adhesive or the like. As previously described, the polyvinylchloride tubing 14 forms an outlet duct (FIG.1) leading to the lagoon 16, and preferably rising into the lagoon near its center.

A rectangular door 26.3 is swingably connected by means of a hinge 26.4 to the upper surface of the connector 28 at its point of connection to the channel lip 26.1 such that the door is freely swingable within the connector 28, as shown in dotted lines in FIG. 2. The dimensions of the door 26.3 are such that the periphery of the door engages the shoulder formed by the terminal end of the lip 26.1 when the door shuts, and it will be noted that the door, when mounted as shown in FIG. 3, operates under the influence of gravity to assume a normally substantially shut position. The purpose of the door 26.3 is to prevent backflow of slurry through the port 12.2 and into the tank. The seal which is formed between the door 26.3 and the outer end 26.2 of the channel need not be air-tight.

An elongated slurry level sensor 30 is positioned within the tank to ride or float upon the liquid manure contained therein. Within the float is an orientation detecting device, which may take the form of a mercury switch 30.2 of known design (FIG. 5). The purpose of the float is to follow the depth of liquid manure within the tank as manure is pressured out through the outlet 12.2, and to halt the flow of compressed air to the tank when the liquid manure has reached a given level. For example, when floating in a substantially horizontal position as shown in solid lines in FIG. 3, the mercury pool 30.3 within the float may lie across two electrical contacts 30.4, 30.5, the contacts leading to a control box 30.1 associated with the compressor and electrically connected thereto so that when a conductive path between the contacts is extablished, the compressor may operate. When the level of liquid manure in the tank has decreased to a level permitting the float 30 to hang substantially vertically, as shown in dotted lines in FIG. 3, the mercury pool may move by force of gravity to a position in which it is no longer in electrical connection with each of the electrodes; the circuit through the float is then broken and the compressor 24 is caused to stop. A tubular tether 32 of rubber or other water-proof, manure-resistant, flexible material is connected at one end to one end of the float and its other end protrudes through an air-tight opening 13 in the top wall of the tank. Wires 32.2 leading from the electrical contacts within the float pass upwardly through the tether 32 and are connected into the control box 30.1. The tether 32 is attached, at a point along its length, to a projection 32.1 depending from the inner surface of the top wall 12.4, and the tube 32 has sufficient strength to not only easily carry the weight of the float but also to withstand the shocks which the float suffers when liquid manure or other slurry is introduced into the tank through the inlet 12.1.

A hose 34 or other source of water under pressure is connected through a valve 34.1 with a water line 34.2 which passes through an air-tight fitting in the top wall 12.4 of the tank and terminates in a sprayhead 34.3. The latter is generally centrally positioned with respect to the vertical axis of the tank and is oriented to deliver a spray of water under pressure against the vertical tank walls to wash down portions of the slurry which may become stuck to the walls. Since, for proper pumping, the contents of the tank 12 must be a semi-liquid slurry, water issuing through the spray head 34.3 also tends to more completely liquefy and reduce the viscosity of the tank contents.

An air outlet pipe 15.1 passes through another air-tight fitting in the top wall 12.4 of the tank, and includes an exterior, manually operated valve 15 for bleeding air under pressure from the tank.

As discussed previously, the compressor may be electrically powered and is controlled not only by its usual on-off switch (not shown), but also by the position of the float 30 in the tank and by a pressure limit switch shown schematically as 24.3 on the control box 30.1 in FIG. 3, the latter switch shutting off the compressor when a given pressure is developed, and turning on the compressor when the pressure has fallen below the given valve. In order for the compressor to operate, the on-off switch to the compressor must be on, the elongated float 30 must be in a generally horizontal position as shown in FIG. 3, and the developed pressure must be less than a given value. A variety of controls suitable for this purpose may be readily devised by the skilled artisan. For example, the pair of wires leading to the float may be in series with the compressor power source such that the compressor will run only when the float is in its floating, or level position with its contacts closed by the pool of mercury. The mercury switch in the float may, in another embodiment, control operation of a solenoid switch in the compressor. It will be understood that when the float is in its "off" position, the limit switch 24.3 will not turn the compressor on. Although the float as described above is preferred since it can be made completely water-proof and is generally not subject to becoming fouled during operation, it will be understood that level sensors of various types may be employed, such as floats carried by arms pivotally connected to the side walls of the tank.

In operation, liquid manure or other semi-liquid slurry is conveyed to the tank 12, as by means of the auger 18.3, until the tank is at least partially filled, the level of the slurry desirably remaining below the open plate 12.8. At this point, the level sensor float floats on top of the liquid manure 31. The air compressor 24 is then started, and air under pressure flows through the air line 24.1 and the exterior and interior valves 24.2, 22.6 to the pneumatic cylinder 22 as shown by arrow A in FIG. 4, causing the piston 22.2 to extend and the plate 12.7 to seal against the gasket 12.6a. The pressure in the air line 24.1 now rises rapidly, since the position of the piston 22.2 in the cylinder 22 is fixed, and when the pressure reaches a predetermined value, such as 20 p.s.i.g., the interior valve 22.6 opens and air under pressure flows through port 22.7 as shown by arrow B in FIG. 4 into the interior of the tank to pressurize the latter. As the pressure in the tank increases, the downward force exerted on the liquid manure 31 eventually becomes sufficiently great to force the liquid manure through the channel 26 and outwardly through the duct 14 and into a storage lagoon. If the consistancy of the liquid manure is too great to allow flow, the viscosity of the manure may be lowered by adding water through the nozzle 34.3.

The safety valve 24.2 may be set to open at a pressure of, for example, 50 p.s.i.g., the latter representing the maximum safe pressure for the tank. The compressor limit switch 24.3 is ordinarily set to operate at the desired internal pumping pressure of the tank, which may, for example, be 30 p.s.i.g. Air from the compressor may enter the tank at a rate far exceeding the outflow rate of liquid manure, unless the slurry is very watery and easily pumped. The pressure in the tank will thus build up to, for example, 30 p.s.i.g. before the compressor shuts off, the compressor coming back on again when the tank pressure has dropped below 30 p.s.i.g. due to outflow of the liquid manure from the tank. The on-off cycling of the compressor thus provides an indication of the flow of liquid manure from the tank, and maintains the tank pressure at about 30 p.s.i.g., although the limit switch may be pre-set to turn the compressor on when the pressure has reached a lower value, for example, 20 p.s.i.g., thus producing a pressure cycling effect in the tank. This effect agitates slightly the liquid manure at the constricted outlet 12.2, and may improve the flow of unusually viscous slurry. The pressure drop across the top plate 12.7, e.g.; 20–30 p.s.i.g., is primarily responsible for maintaining the plate sealingly against the gasket 12.6a.

When the level of liquid manure in the tank has decreased to a given level and the float reaches the end of its tether to the projection 32.1, the float assumes a more or less vertical position, as shown in FIG. 3, and the compressor is shut off as described above. The pressure within the tank then gradually recedes due to the continued passage of manure outwardly of the tank through the duct 14. Pressure may also be released by opening the air valve 15 in the top of the tank. As the pressure in the tank drops, liquid manure in the duct 14 may tend to flow back into the tank. The hinged door 26.3, no longer being held open by the outflow of liquid manure, swings into its closed position under the backflow force of the liquid manure or by force of gravity or both. When the pressure in the tank has decreased to ambient pressure, and the bleeder valve 24.4 is opened, the plate 12.7 at the top of the tank opens under its own weight, forcing the piston 22.2 to retract within the cylinder and causing air to be drawn through the filter 22.5 into the forward end of the cylinder, the filter maintaining the cleanliness of the cylinder. Water may then be introduced into the tank through the sprayhead 34.3 to wash down the walls of the tank and to provide a small amount of water in the tank bottom to reduce the viscosity of the next batch of liquid manure so that that batch of liquid manure may readily begin its passage through the duct 14.

The pump of the invention may be used for various semi-liquid slurrys, but is particularly useful on farms in pumping liquid manure, as described above. As an example, for a herd of 125 dairy cows, a tank having a liquid manure capacity of 1000 gallons will be adequate. To allow space for the inward opening of the plate 12.7, this tank may have a total internal volume of about 1700 gallons, and may be fabricated throughout from 5/16 inch cold rolled steel with the dished top and bottom walls welded to the cylindrical side wall. A rectangular inlet 12.1, 14 × 18 inches, may be provided in the top wall 12.4, and the closure plate may be 18 × 22 inches to contact the inlet and provide a 2 inch overlap margin. The slot 13.1 in the bottom wall of the tank may be approximately 12 inches in width, and the channel 26 may be of ¼ inch steel to provide a ¼ inch wide shoulder against which the door 26.3 abuts.

While we have described a preferred embodiment of the present invention, it should be understood that various changes, adaptations, and modifications may be made therein without departing from the spirit of the invention and the scope of the appended claims.

What is claimed:

1. A slurry pump particularly useful for pumping liquid manure and comprising:

a pressure tank with an inlet for admission of slurry to the tank and a lower outlet for passage of slurry from the tank, the inlet having a hinged plate swingable inwardly from the inlet and including an air-operated pneumatic cylinder and piston attached internally of the tank and oriented to force the plate upwardly and outwardly to provide an air-tight seal at the inlet when the piston is extended from the cylinder, and the outlet having means preventing backflow of slurry through the outlet;

a source of air under pressure and an air line extending from the source of air and passing through a wall of the tank and communicating internally of the tank with the pneumatic cylinder to actuate the same, the air line including a pressure-actuated directional valve communicating in its closed position with the pneumatic cylinder and in its opened position with the tank to supply air under pressure to the latter when the pressure of air driving the pneumatic cylinder has reached a predetermined value;

level sensor means for sensing the recedence of slurry below a predetermined level as slurry is pumped from the pressure tank; and control means responsive to the level sensor means for discontinuing the flow of pressurized air to the tank when the slurry level has decreased to the predetermined level.

2. The slurry pump of claim 1 wherein the closure plate is of sufficient weight to swing open under the force of gravity when otherwise unrestrained, retracting the piston into the cylinder.

3. The slurry pump of claim 1 wherein the level sensor means comprises a float tethered within the tank and having a first position in which the float floats upon the slurry within the tank and a second position wherein the float is suspended from its tether, the float having internal electrical contacts communicating electrically with the source of air under pressure and means closing and opening the contacts in response to movement of the sensor between its first and second positions to shut off the flow of pressurized air to the tank when the sensor moves from the first position to the second position.

4. The slurry pump of claim 3 wherein the source of air under pressure is an electric motor-driven air compressor including a limit switch for shutting off the compressor when the pressure pumped against exceeds a predetermined upper pressure and turning on the compressor when the pressure pumped against has fallen below a lower predetermined pressure, whereby the slurry within the tank during the pumping operation is subjected to pressure cycling between the upper and lower predetermined pressures.

5. The slurry pump of claim 1 including a door hinged to the outlet of the tank and oriented to open outwardly against the force of gravity and closeable inwardly of the tank to prevent the backflow of slurry therewithin.

6. A slurry pump particularly useful for pumping liquid manure and comprising a. a pressure tank with top and bottom walls, the top wall having an inlet for admission to the tank of liquid manure and having an internal, gasketed peripheral surface, closure plate openable inwardly of the tank and internally hinged to the top wall, the closure plate being swingable upwardly into sealing contact against the gasketed inner periphery of the inlet, a pneumatic cylinder mounted internally of the tank at one end and having an extendable piston attached to the closure plate, the pneumatic cylinder and piston being oriented to force the plate upwardly into sealing engagement with the inlet periphery upon extension of the piston from the cylinder, the bottom wall of the tank including a channel opening generally transversely outwardly of the tank and having an outer end connectable to a duct for conveying liquid manure to a storage area, the outer end of the channel including a top-hinged door swingable outwardly and upwardly to permit outflow of liquid manure through the channel, and closeable inwardly to prevent backflow of liquid manure into the tank;

b. an electrically operated air compressor including a limit switch for shutting the compressor off when the pressure pumped against by the compressor exceeds a predetermined upper pressure and turning on the compressor when the pressure pumped against has fallen below a lower predetermined pressure;

c. an air line for carrying air under pressure from the compressor to the tank, the air line extending through the top wall of the tank and including internally of the tank a pressure actuated directional valve communicating in its closed position with the pneumatic cylinder and in its opened position with the tank to supply air under pressure to the tank when the pressure of air driving the cylinder has reached a predetermined value;

d. a level sensor float tethered to the top wall internally of the tank and having a first position in which the float is carried upon the surface of liquid manure within the tank and a second position wherein the float is suspended from its tether when liquid manure within the tank has receded to a predetermined level, the float having internal electrical contacts, and means closing and opening the contacts in response to movement of the sensor between its first, floating position and its second, tether-supported position; and e. control means electrically connected to the electrical contacts of the float for shutting off the air compressor in response to movement of the float from its floating to its tether-supported position.

7. The slurry pump of claim 6 including a source of water under pressure, a water line extending through the top wall of the tank and terminating internally of the tank in a generally centrally positioned sprayhead to wash down the tank walls.

8. A slurry pump particularly useful for pumping liquid manure and comprising:

a pressure tank with an inlet for admission of slurry to the tank and a lower outlet for passage of slurry from the tank, the inlet having a hinged closure for closing the inlet with an air-tight seal;

a source of air under pressure;

a pneumatic cylinder attached to the closure to close the latter upon application of air under pressure to the cylinder; and air conveying means including a pressure-actuated directional valve for conveying air under pressure from the source of pressurized air to the cylinder and to the tank, said valve conveying pressurized air to the tank only when the closure has been closed and the pressure of air driving the cylinder has increased to a predetermined value.

9. The slurry pump of claim 8 in which the tank has a top wall with the inlet positioned centrally thereof.

10. The slurry pump of claim 9 in which the tank has a floor sloping towards its center and said outlet extending substantially to the center of the floor.

* * * * *